US005125811A

United States Patent [19]

Amano et al.

[11] Patent Number: 5,125,811

[45] Date of Patent: Jun. 30, 1992

[54] SINTERED IRON-BASE ALLOY VANE FOR COMPRESSORS

[75] Inventors: Nobuya Amano; Naoki Motooka, both of Itami, Japan

[73] Assignee: Sumitomo Electric Industries, Ltd., Osaka, Japan

[21] Appl. No.: 623,660

[22] PCT Filed: Apr. 27, 1990

[86] PCT No.: PCT/JP90/00561

§ 371 Date: Dec. 28, 1990

§ 102(e) Date: Dec. 28, 1990

[30] Foreign Application Priority Data

Apr. 28, 1989 [JP] Japan ..... 1-110856

[51] Int. Cl.[5] ..... F03C 2/00

[52] U.S. Cl. ..... 418/179; 29/888.025; 29/889.7; 419/38

[58] Field of Search ..... 29/889.7, 888.025; 418/179; 419/23, 38

[56] References Cited

U.S. PATENT DOCUMENTS

| | | | |
|---|---|---|---|
| 4,490,175 | 12/1984 | Matsuzaki | 418/179 |
| 4,772,450 | 9/1988 | Friedman | 29/889.7 |
| 4,817,858 | 4/1989 | Verpoort | 29/899.7 |
| 4,859,164 | 8/1989 | Shimomura | 418/179 |

*Primary Examiner*—Irene Cuda

*Attorney, Agent, or Firm*—Cushman, Darby & Cushman

[57] ABSTRACT

A compressor vane of a sintered iron-base alloy composed of an iron-base matrix containing hard carbides uniformly dispersed therein, characterized in that the sintered iron-base alloy consists essentially of 0.7 to 1.5% by weight C, 3.0 to 5.0% by weight Cr, 0 to 10.0% by weight Mo, 1 to 20.0% by weight W, 0.5 to 6.0% by weight V, 0 to 15.0% by weight Co and the balance iron and inevitable impurities, and that the compressor vane is produced by molding under a pressure of 5 to 8 ton/cm$^2$ and then sintering at a temperature of less than 1250° C. so as to control particle size of the hard carbide to not more than 5 μm, as well as to control the theoretical relative density to 80 to 90%, and to control the macro-hardness to 10 to 45 in the Rockwell C scale.

2 Claims, No Drawings

SINTERED IRON-BASE ALLOY VANE FOR COMPRESSORS

TECHNICAL FIELD

The present invention relates to a compressor vane and, more particularly, a sintered iron-base alloy vane for a compressor required to have wear resistant properties.

BACKGROUND ART

In general, as a material for fluid-pressurizing vanes which are sliding parts of compressors, there have generally been used special cast irons, and high-carbon or high speed tool steels with excellent wear resistance. Also, carbon vanes are sometimes used for heavy-load compressors.

However, with development of compressors with higher performance and larger load-carrying capacity, it has been found that the special cast-iron vanes involve such a problem that they are poor in wear resistance. On the other hand, the high-carbon or high speed tool steel vanes possess excellent wear resistance as their hardness may be improved by thermal treatments, but they attack opposing parts and cause seizure because of their poor self-lubricating ability. Also, the carbon vanes have such a problem that they are too expensive.

Recently, sintered alloy vanes produced by sintering have partially received practical application. Such sintered alloy vane are composed, as disclosed in the Japanese Patent Gazette of laying-open No. 59-16952 for example, of a sintered iron-base alloy consisting of a matrix of a base metal of iron and hard particles such as carbides dispersed in the matrix. In such vanes, the mechanical strength of the matrix is ensured by increasing the theoretical relative density to not less than 92%, while the wear resistance is improved by dispersion of the hard particles with a diameter of not less than 5 μm into the matrix. Also, such sintered alloy vanes have a further advantage such that they possess self-lubricating when oil is impregnated into their pores.

However, the above sintered iron-base alloy vanes attack opposing parts and cause a seizure in a manner similar to the aforesaid steel vanes because of their high hardness of a macro-structure including the dispersed hard particles, which results from high theoretical relative density of not less than 92%.

DISCLOSURE OF INVENTION

The present invention has been made under such situations of the prior art to provide a sintered iron-base alloy vane, which possesses high wear resistance but does not damage opposing parts, for use in compressors which are advancing increase in performance and in load-carrying capacity.

According to the present invention, the above and other objects are achieved by molding a sintered iron-base alloy, which is composed of a matrix of a base metal of iron and containing hard carbides uniformly dispersed therein, and which consists essentially of 0.7 to 1.5% by weight C, 3.0 to 5.0% by weight Cr, 0 to 10.0% by weight Mo, 1 to 20.0% by weight W, 0.5 to 6.0% by weight V, 0 to 15.0% by weight Co and the balance iron and inevitable impurities, under a pressure of 5 to 8 ton/cm$^2$, and then sintering compacts at a temperature of less than 1250° C. so as to control particle size of the hard carbide to not more than 5 μm, as well as to control the theoretical relative density to 80 to 90%, and to control the macro-hardness to 10 to 45 in the Rockwell C scale.

The sintered iron-base alloy used for compressor vanes of the present invention is not limited in its composition, and may be the one conventionally used as a sintered material for sintered iron-base vanes, or the one having any composition composed of a base metal of iron and containing a hard carbide uniformly dispersed therein. It is, however, preferred to use a sintered iron-base alloy having a composition consisting essentially of 0.7 to 1.5 wt % C, 3.0 to 5.0 wt % Cr, 0 to 10.0 wt % Mo, 1 to 20.0 wt % W, 0.5 to 6.0 wt % V, 0 to 15.0 wt % Co, and the balance iron and inevitable impurities.

The hard carbide may be the one conventionally used in sintered iron-base alloy vanes. For example, there may be used those such as carbides of Cr, Mo, V, W and the like. It is, however, preferred to use carbides with a particle size of not more than 5 μm.

The above sintered iron-base alloy may further contain 0.5 to 3% by weight of at least one solid lubricant selected from the group consisting of $CaF_2$, $BaF_2$, $MoS_2$ and $WS_2$ as occasion demands, which is incorporated into the alloy to improve its self-lubricating ability.

The sintered iron-base alloy vanes are produced by powder metallurgy, but it is required to produce the same by molding powdered raw materials into compacts in the form of vanes under a pressure of 5 to 8 ton/cm$^2$, and then sintering the compacts at a temperature of less than 1250° C., preferably, at a temperature ranging from 1000° to 1200° C. to achieve the object of the present invention. In general, the resultant sintered bodies are treated before use by hardening and tempering to improve its wear resistance.

The sintered iron-base alloy for vanes of the present invention are sintered under the above conditions to control the particle size of hard carbides dispersed in the matrix to not more than 5 μm, as well as to control the theoretical relative density to 80 to 90% and to control the macro-hardness to 10 to 45 in the Rockwell C scale. Thus, the sintered iron-base alloy vanes possess excellent self-lubricating and sliding-movement properties and don't cause damage such as part seizures as they are lowered in aggression to the opposing parts.

The reasons why the production conditions, particle size of the hard carbide in the matrix, theoretical relative density, and macro-hardness of the sintered alloy vanes of the present invention have been limited as above are as follows.

The molding pressure of powder of raw materials has been limited to 5 to 8 ton/cm$^2$ for the following reasons: If the molding pressure is less than 5 ton/cm$^2$, the relative density after sintering becomes less than 80%, thus making it impossible to obtain sufficient mechanical strength and wear resistance required for vanes. If the molding pressure is more than 8 ton/cm$^2$, there is a possibility of the relative density exceeding 90%, so that the aggression to the opposing parts increases.

If the sintering temperature is not less than 1250° C., the particle size of the carbide exceeds 5 μm because of increase of the generation of a liquid phase during sintering, which causes increase in the grain size of the carbide.

The reasons why the particle size of the hard particles in the matrix has been limited to not more than 5 μm are as follows. If the particle size exceeds 5 μm, the aggression to the opposing parts increases.

If the theoretical relative density is less than 80%, the vanes are insufficient in the strength and lack the wear resistance because of lowering of the hardness. If the theoretical density exceeds 90%, the hardness becomes considerably increased, thus making it difficult to control the macro-hardness to a value within the scope of the present invention even if the products are subjected to the thermal treatments such as annealing in the subsequent steps. As a result, the aggression to the opposing parts becomes a problem.

Further, the reasons why the hardness of the macro structure has been limited to 10 to 45 in the Rockwell C scale are as follows. If the macro-hardness is less then 10, the wear resistance of the vanes becomes insufficient. If the macro-hardness exceeds 45, the aggression to the opposing parts becomes considerably increased.

The reasons why the amount of the solid lubricant to be incorporated into the alloy to improve the self-lubricating ability has been limited to 0.5 to 3 wt % are as follows: If the added amount of the solid lubricant is less than 0.5 wt %, the self-lubricating property is scarcely obtained. If the added amount of the solid lubricant exceeds 3 wt %, the quality of the compacted body before sintering becomes lowered and the expansion tend to be taken place during sintering take place. Also, the deflective strength of the vanes becomes considerably lowered.

According to the present invention, it is possible to provide sintered iron-base alloy vanes for use in compressors with increasing performance and load-carrying capacity, which possess high wear resistance and retain stable sliding-movement properties for a long period of time without causing damage of the opposing parts.

Accordingly, it is possible to considerably cut down the manufacturing cost of heavy-load compressors by using the sintered iron-base alloy vanes of the present invention instead of the expensive carbon vanes.

BEST MODE FOR CARRYING OUT THE INVENTION

EXAMPLE 1

Alloy powder, a minus sieve of a 100 mesh screen, consisting of, 1.1% by weight C, 6.1% by weight W, 5.0% by weight Mo, 4.0% by weight Cr, 2.0% by weight V and the valance iron and inevitable impurities was mixed with 0.8% by weight of zinc stearate serving as a molding auxiliary, and then molded in the form of compressor vanes under a pressure ranging from 4 to 8 ton/cm$^2$. The compacted bodies were sintered in vacuum at a temperature of 1180° to 1250° C. for 1 hour, and then treated by gas-hardening in $N_2$ gas from 1150° C. and tempering twice at 500° to 650° C. to provide sintered iron-base alloy vanes as specimens 1-1 to 1-12.

For each of the resultant vanes, measurements were made on theoretical relative density, macro-hardness (Rockwell C scale) and particle size of carbides. Separate from the above, each vane was assembled into a compressor to perform durability tests for 500 and 1500 hours. In this case, a piston, i.e., an opposing part, of the compressor is of Mo-Ni-Cr cast iron and a cylinder is of cast iron. The results are shown in Table 1.

As will be understood from Table 1, specimens 1-3 to 1-10 according to the present invention possess excellent wear resistance, whereas specimens 1-1 and 1-2 which are low in the theoretical relative density and in macro-hardness possess large wear. The specimens 1-11 and 1-12, which are large in particle size of the carbide and high in theoretical relative density and in high macro-hardness, aggress the opposing parts heavily, resulting in considerable wear of the opposing parts.

TABLE 1

| Specimen | Molding Pressure (ton/cm$^2$) | Sintering temp. (°C.) | Tempering temp. (°C.) | Particle size of carbide (μm) | Relative Density (%) | Macro-Hardness ($H_RC$) | Durability Test 500 hrs | Durability Test 1500 hrs |
|---|---|---|---|---|---|---|---|---|
| 1-1 | 4 | 1180 | 650 | 3-5 | 78 | 5-8 | Wear: large | Wear: large |
| 1-2 | " | " | 640 | " | " | 6-11 | good | Wear: large |
| 1-3 | 5 | " | " | 2-5 | 80 | 10-15 | " | good |
| 1-4 | " | " | 620 | 3-5 | " | 15-20 | " | " |
| 1-5 | 6 | " | " | " | 83 | 13-18 | " | " |
| 1-6 | " | " | 600 | 2-5 | " | 18-23 | " | " |
| 1-7 | 7 | " | 580 | 2-4 | 85 | 27-32 | " | " |
| 1-8 | " | " | 560 | 3-5 | " | 29-35 | " | " |
| 1-9 | 8 | " | 540 | 2-3 | 90 | 35-40 | " | " |
| 1-10 | " | " | 520 | 2-4 | " | 38-44 | " | " |
| 1-11 | " | 1250 | " | 6-10 | 92 | 45-49 | " | Wear of opposing part: large |
| 1-12 | " | " | 500 | 7-10 | " | 50-55 | " | Wear of opposing part: large |

EXAMPLE 2

Alloy powder, a minus sieve of a 100 mesh screen, consisting essentially of 1.5% by weight C, 12% by weight W, 0.3% by weight Mo, 4.0% by weight Cr, 4.5% by weight V and the valance iron and inevitable impurities, was added with 0 to 5% by weight of a solid lubricant and 0.8% by weight of the molding auxiliary. The resultant mixture was molded into compacts in the form of a plate with 30×20×5 mm under a pressure of 6 ton/cm$^2$. The compacts were sintered in vacuum at 1180 ° C. for 1 hour, gas-hardened with $N_2$ gas from 1150° C., and then tempered twice at 580 ° C. to prepare specimens.

For each of the resultant specimens 2-1 to 2-10, measurements were made on the theoretical relative density, macro-hardness (Rockwell C scale), particle size of carbide in a manner similar to that of Example 1. Also, for each specimen, wear resistance test was carried out, using the specimen as a fixed member and a Meehanite cast iron plate of a 30 mm outer diameter×16 mm inner diameter×3 mm height as a rotating member (Test conditions: Velocity of rotating member: 5 m/sec, Time: 10 hours, no lubricant), to determine the maximum depth of wear formed in the specimen which is the fixed member. The results are summarized in Table 2.

TABLE 2

| Specimen | Solid lubricant Kind | Solid lubricant Added Amount (% by weight) | Particle size of carbide (μm) | Relative Density (%) | Macro-Hardness ($H_RC$) | Depth of Wear (mm) | Deflective Strength (kg) |
|---|---|---|---|---|---|---|---|
| 2-1 | — | 0 | 3-5 | 83 | 13-18 | 0.32 | 3650 |
| 2-2 | $CaF_2$ | 0.2 | 3-4 | " | 14-19 | 0.34 | 3500 |
| 2-3 | $MoS_2$ | 0.5 | 3-5 | " | 13-16 | 0.28 | 3450 |
| 2-4 | $CaF_2$ | 1 | 3-4 | " | 15-20 | 0.24 | 3300 |
| 2-5 | $MoS_2$ | 1 | 3-5 | 82 | 14-16 | 0.22 | 3350 |
| 2-6 | $CaF_2$ | 3 | 2-4 | " | 15-18 | 0.18 | 3200 |
| 2-7 | $MoS_2$ | 3 | 2-5 | " | " | 0.20 | 3050 |
| 2-8 | $CaF_2 + MoS_2$ | 3 | 2-4 | 81 | 13-15 | " | 3100 |
| 2-9 | $CaF_2$ | 5 | 2-5 | 80 | 11-14 | 0.19 | 2650 |
| 2-10 | $CaF_2 + MoS_2$ | 5 | 2-5 | " | 10-13 | 0.20 | 2600 |

As will be understood from Table 2, the specimens with the content of the solid lubricant being 0.2% by weight possess a wear depth same as that of the specimen containing no lubricant. In contrast therewith, it was observed that the lubricant added in an amount of not less than 0.5% by weight causes reduction in the wear depth because of improvement in the self-lubricating properties. However, the deflective strength was considerably lowered when the content of the lubricant is incorporated in an amount of more than 3% by weight.

EXAMPLE 3

Alloy power, a minus sieve of a 100 mesh screen, consisting essentially of 1.5 wt % C, 1.0 wt % Mo, 12 wt % Cr, 0.5 wt % V and the valance iron and inevitable impurities, was mixed with 0.8 wt % of the molding auxiliary, and then compacted to provide cylinders with 15 mm in diameter × 20 mm in length under a pressure of 7 ton/cm$^2$. The compacts were sintered in vacuum at 1180° to 1250° C. for 1 hour, then gas-hardened in $N_2$ gas from 1150° C., and tempered twice at 580° C.

For each of the resultant specimens 3-1 to 3-6, measurements were made on the theoretical relative density, macro-hardness (Rockwell C scale, and particle size of carbides in a manner similar to Example 1. Also, using each specimen as a fixed member, and a Meehanite cast iron ring of 20 mm (outer diameter) × 12 mm (inner diameter) × 20 mm (length) as a rotating member, a wear resistance test was carried out for each specimen. Test conditions are: velocity of a rotating member 7 m/sec, Time: 1 hours, no lubricant. Load: 40 kg). The width of wear formed on the fixed member, i.e., specimen, and reduction in diameter of the rotating member were measured. For comparison, there were prepared comparative specimens 3-7 to 3-10 made of a molten alloy and having the same dimensions that the specimen have. For each comparative specimen, wear resistance test was carried out in the same manner mentioned above. The results are shown in Table 3.

TABLE 3

| Specimen | Kind | Sintering temp. (°C.) or Material | Particle Diameter of carbide (μm) | Relative Density (%) | Macro-Hardness ($H_RC$) | Width of Wear for fixed member (mm) | Reduction in Diameter of rotating member (mm) |
|---|---|---|---|---|---|---|---|
| 3-1 | Sintered material | 1180 | 2-4 | 85 | 28-33 | 0.40 | 0.010 |
| 3-2 | Sintered material | " | " | 87 | 32-40 | 0.39 | 0.010 |
| 3-3 | Sintered material | 1200 | 3-5 | 88 | 35-42 | 0.38 | 0.015 |
| 3-4 | Sintered material | " | " | 90 | 39-45 | 0.35 | " |
| 3-5 | Sintered material | 1250 | 5-8 | 92 | 48-52 | 0.33 | 0.030 |
| 3-6 | Sintered material | " | 7-10 | 95 | 55-60 | 0.30 | 0.040 |
| 3-7 | Molten material | SUJ-2 | 10-20 | 100 | 60-63 | 0.25 | 0.050 |
| 3-8 | Molten material | SKH-9 | " | " | 63-65 | 0.23 | 0.055 |
| 3-9 | Molten material | SKD-11 | " | " | 60-63 | 0.26 | 0.050 |
| 3-10 | Molten material | Special cast iron | 15-30 | " | 40-43 | 0.38 | 0.030 |

As will be understood from Table 3, the specimens 3-5 and 3-6 of a sintered material, and specimens 3-7 to 3-10 of a molten material are small in wear because of large particle size of carbide and large macro-hardness, but the wear of the opposing parts (rotating member) becomes considerably increased and is two or more times that of the specimen 3-1 to 3-4 of the present invention.

We claim:

1. A compressor vane of a sintered iron-base alloy composed of an iron-base matrix containing hard carbides uniformly dispersed therein, characterized in that said sintered iron-base alloy consists essentially of 0.7 to 1.5% by weight C, 3.0 to 5.0% by weight Cr, 0 to 10.0% by weight Mo, 1 to 20.0% by weight W, 0.5 to 6.0% by weight V, 0 to 15.0% by weight Co and the balance iron and inevitable impurities, said compressor vane of a sintered iron-base alloy being produced by molding under a pressure of 5 to 8 ton/cm$^2$ and then sintering at a temperature of less than 1250° C. so as to control particle size of the hard carbide to not more than 5 μm, as well as to control the theoretical relative density to 80 to 90%, and to control the macro-hardness to 10 to 45 in the Rockwell C scale.

2. A compressor vane of a sintered iron-base alloy according to claim 1 wherein said matrix contains 0.3 to 3 wt % of at least one solid lubricant selected from the group consisting of $CaF_2$, $BaF_2$, $MoS_2$ and $WS_2$.

* * * * *